US011365861B2

(12) United States Patent
Han et al.

(10) Patent No.: US 11,365,861 B2
(45) Date of Patent: Jun. 21, 2022

(54) VEHICLE LAMP WITH A PLURALITY OF SHIELDS

(71) Applicant: SL Corporation, Daegu (KR)

(72) Inventors: Hyo Jin Han, Gyeongsan-si (KR); Dong Hyun Go, Gyeongsan-si (KR); Kyung Su Lee, Gyeongsan-si (KR)

(73) Assignee: SL Corporation, Daegu (KR)

( * ) Notice: Subject to any disclaimer, the term of this patent is extended or adjusted under 35 U.S.C. 154(b) by 0 days.

(21) Appl. No.: 17/326,618

(22) Filed: May 21, 2021

(65) Prior Publication Data

US 2021/0404621 A1 Dec. 30, 2021

(30) Foreign Application Priority Data

Jun. 29, 2020 (KR) ..... 10-2020-0079382

(51) Int. Cl.
*F21S 41/265* (2018.01)
*F21S 41/68* (2018.01)
(Continued)

(52) U.S. Cl.
CPC ..... *F21S 41/265* (2018.01); *F21S 41/43* (2018.01); *F21S 41/68* (2018.01); *F21W 2102/155* (2018.01)

(58) Field of Classification Search
CPC ..... F21S 41/265; F21S 41/43; F21S 41/68; F21W 2102/155; G02B 3/0056; G02B 3/0043; G02B 3/0062; G02B 3/0068
See application file for complete search history.

(56) References Cited

U.S. PATENT DOCUMENTS 10,465,874 B2 * 11/2019 Kamau ..... F21V 5/002
2016/0010811 A1 * 1/2016 Benitez ..... F21V 11/186 362/147

(Continued)

FOREIGN PATENT DOCUMENTS

EP 3495718 A1 6/2019
EP 3647653 A1 5/2020

(Continued)

OTHER PUBLICATIONS

Kim, Lamp for vehicle, Feb. 11, 2019, KR20190012438A, Google Patents, https://patents.google.com/patent/KR20190012438A/en?oq=kr20190012438 (Year: 2019).*

*Primary Examiner* — Rajarshi Chakraborty
*Assistant Examiner* — Michael Chiang
(74) *Attorney, Agent, or Firm* — United One Law Group LLC; Kongsik Kim; Jhongwoo Peck

(57) ABSTRACT

A vehicle lamp includes a light source unit; an incident lens unit that comprises a plurality of incident lenses on which light is incident from the light source unit; an exit lens unit that comprises a plurality of exit lenses outputting the light incident from the incident lens unit; and a shield unit that obstruct a part of the light travelling toward each of the exit lenses. The shield unit comprises a plurality of shields that obstruct a part of the light travelling toward each of the exit lenses, and an upper end of each of the shields comprises a horizontal part that extends horizontally from the center of the upper end toward a shield adjacent thereto, and a connection part that extends from the horizontal part toward the adjacent shield at an angle different from the horizontal part.

11 Claims, 24 Drawing Sheets

(51) Int. Cl.
*F21S 41/43* (2018.01)
*F21W 102/155* (2018.01)

(56) References Cited

U.S. PATENT DOCUMENTS

| | | | | |
|---|---|---|---|---|
| 2016/0265733 | A1* | 9/2016 | Bauer | F21S 41/16 |
| 2019/0072252 | A1* | 3/2019 | Moser | F21S 41/68 |
| 2020/0300435 | A1* | 9/2020 | Mandl | F21S 41/265 |
| 2020/0370726 | A1* | 11/2020 | Mandl | F21S 41/143 |

FOREIGN PATENT DOCUMENTS

| | | | | | |
|---|---|---|---|---|---|
| JP | 2018-531496 | A | | 10/2018 | |
| KR | 10-2019-0012438 | A | | 2/2019 | |
| KR | 20190012438 | A | * | 2/2019 | F21S 41/20 |
| WO | 2017/066818 | A1 | | 4/2017 | |

* cited by examiner

VEHICLE LAMP WITH A PLURALITY OF SHIELDS

CROSS-REFERENCE TO RELATED APPLICATION

This application claims priority to Korean Patent Application No. 10-2020-0079382, filed on Jun. 29, 2020, the disclosure of which is incorporated herein by reference in its entirety.

BACKGROUND

1. Technical Field

The present disclosure relates to a vehicle lamp, and more particularly, to a vehicle lamp which can form a low beam pattern having a predetermined cutoff line so as not to dazzle drivers of vehicles ahead.

2. Related Art

Generally, a vehicle includes various types of lamps having an illumination function and a signaling function. The illumination function enables the driver of the vehicle to easily detect objects around the vehicle while driving in low-light conditions (e.g., at night), and the signaling function is used to inform other vehicles and road users of the vehicle's driving state.

For example, a headlamp and a fog lamp are designed primarily for the illumination function, and a turn signal lamp, a tail lamp, a brake lamp, and a side marker are designed primarily for the signaling function. In addition, installation standards and specifications of these vehicle lamps are promulgated by regulations, so that each function can be fully exerted.

Recently, research has been actively conducted to reduce the size of a vehicle lamp using micro lenses having a relatively short focal length.

Among the lamps for a vehicle, a headlamp that forms various beam patterns such as a low beam pattern and a high beam pattern to secure a driver's forward view during night driving plays an important role in safe driving. In particular, light of a low beam pattern is irradiated below a predetermined cutoff line so as not to dazzle the drivers of vehicles ahead such as preceding vehicles or oncoming vehicles.

Here, when a low beam pattern is formed using a plurality of micro lenses, the low beam pattern is formed by overlapping the light that exit from the micro lenses, and a plurality of shields are provided to form a cutoff line by obstructing a part of light that is incident on each of the micro lenses.

When a part of light to be incident on each of the micro lenses is blocked using the shields, there is a possibility that optical interference may occur between adjacent shields due to their relatively small size. In this case, an abnormal cutoff line may be formed, thus increasing the likelihood of a car accident.

Therefore, it is required to implement ways to prevent optical interference between the shields that obstruct a part of light that is incident on each of the micro lenses.

SUMMARY

Aspects of the present disclosure provide a vehicle lamp that prevents the formation of an abnormal (e.g., unnatural-looking or undesirable) beam pattern due to a height difference between adjacent shields among a plurality of shields disposed in horizontal or left-and-right directions.

However, aspects of the present disclosure are not restricted to the ones set forth herein. The above and other aspects of the present disclosure will become more apparent to one of ordinary skill in the art to which the present disclosure pertains by referencing the detailed description of the present disclosure given below.

According to an aspect of the present disclosure, a vehicle lamp may include a light source unit; an incident lens unit that comprises a plurality of incident lenses on which light is incident from the light source unit; an exit lens unit that comprises a plurality of exit lenses outputting the light incident from the incident lens unit; and a shield unit that obstructs a part of the light travelling toward each of the exit lenses. The shield unit may include a plurality of shields that obstruct a part of the light travelling toward each of the exit lenses. In particular, an upper end of each of the shields may include a horizontal part that extends horizontally from a center of the upper end toward an adjacent shield in left and right directions and a connection part that extends from the horizontal part toward the adjacent shield at an angle different from the horizontal part.

The light source unit may comprise a light source and a light path adjustment unit that adjusts the path of the light to cause the light generated from the light source unit to travel substantially parallel to an optical axis of the light source. The light path adjustment unit may comprise at least one of an aspheric lens or a Fresnel lens.

Each of the shields may be formed such that a line connecting both ends of the horizontal part in the left and right directions and a line connecting both ends of the connection part form an obtuse angle. Further, the shields may be formed such that the connection parts of adjacent shields are connected without forming a step. In each of the shields, a first end of the connection part that is closer to the adjacent shield may be disposed higher or lower than a second end of the connection part that is connected to the horizontal part. The connection part may be shaped as a straight line, a curve, or a combination thereof.

The incident lenses and the exit lenses may be disposed such that one or more rows extending in the left and right directions are arranged in up and down directions, and a direction in which the connection part is formed may vary in accordance with an angle of the rows extending in the left and right directions with respect to a horizontal direction.

At least some of the shields may include a protrusion that protrudes upward on the upper end thereof. The shield unit may further comprise a plurality of additional shields disposed in front of the shields, respectively, along the traveling direction of the light.

The incident lenses and the exit lenses may be disposed such that one or more rows extending in the left and right directions are arranged in the up and down directions, and when the rows extending in the left and right directions are inclined at a predetermined angle with respect to a horizontal direction, upper and/or lower sides of additional shields adjacent to each other in the left and right directions may have different positions in the up and down directions.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
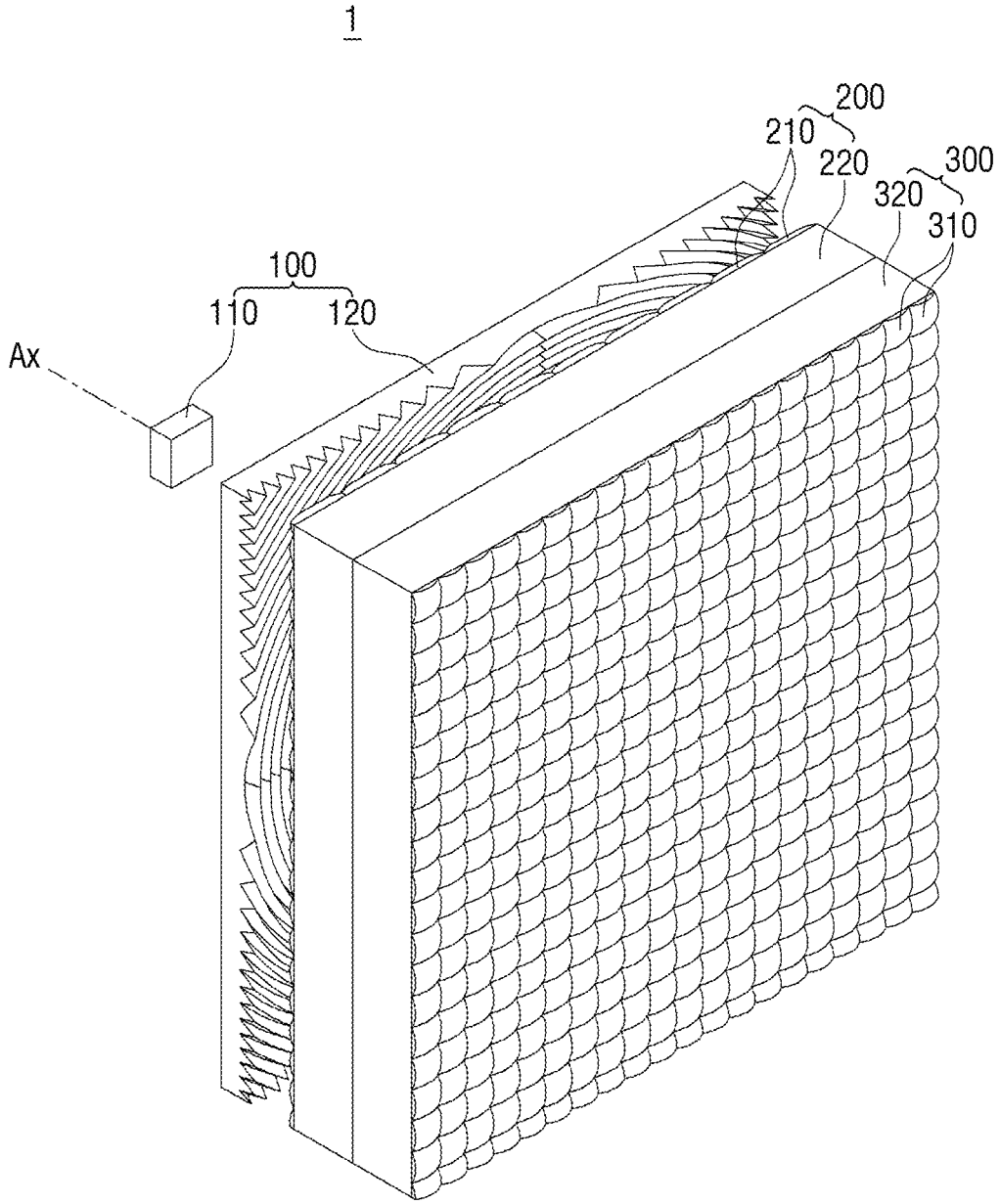
FIGS. 1 and 2 are perspective views of a vehicle lamp according to an embodiment of the present disclosure.

Advantages and features of the present invention and methods of accomplishing the same may be understood more readily by reference to the following detailed description of exemplary embodiments and the accompanying drawings. The present invention may, however, be embodied in many different forms and should not be construed as being limited to the embodiments set forth herein. Rather, these embodiments are provided so that this disclosure will be thorough and complete and will fully convey the concept of the invention to those skilled in the art, and the present invention will only be defined by the appended claims. Throughout the specification, like reference numerals in the drawings denote like elements.

In some embodiments, well-known steps, structures and techniques will not be described in detail to avoid obscuring the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Embodiments of the invention are described herein with reference to plan and cross-section illustrations that are schematic illustrations of idealized embodiments of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing. In the drawings, respective components may be enlarged or reduced in size for convenience of explanation.

Hereinafter, the present disclosure will be described with reference to the drawings for describing vehicle lamps according to embodiments of the present disclosure.

Figure 2:
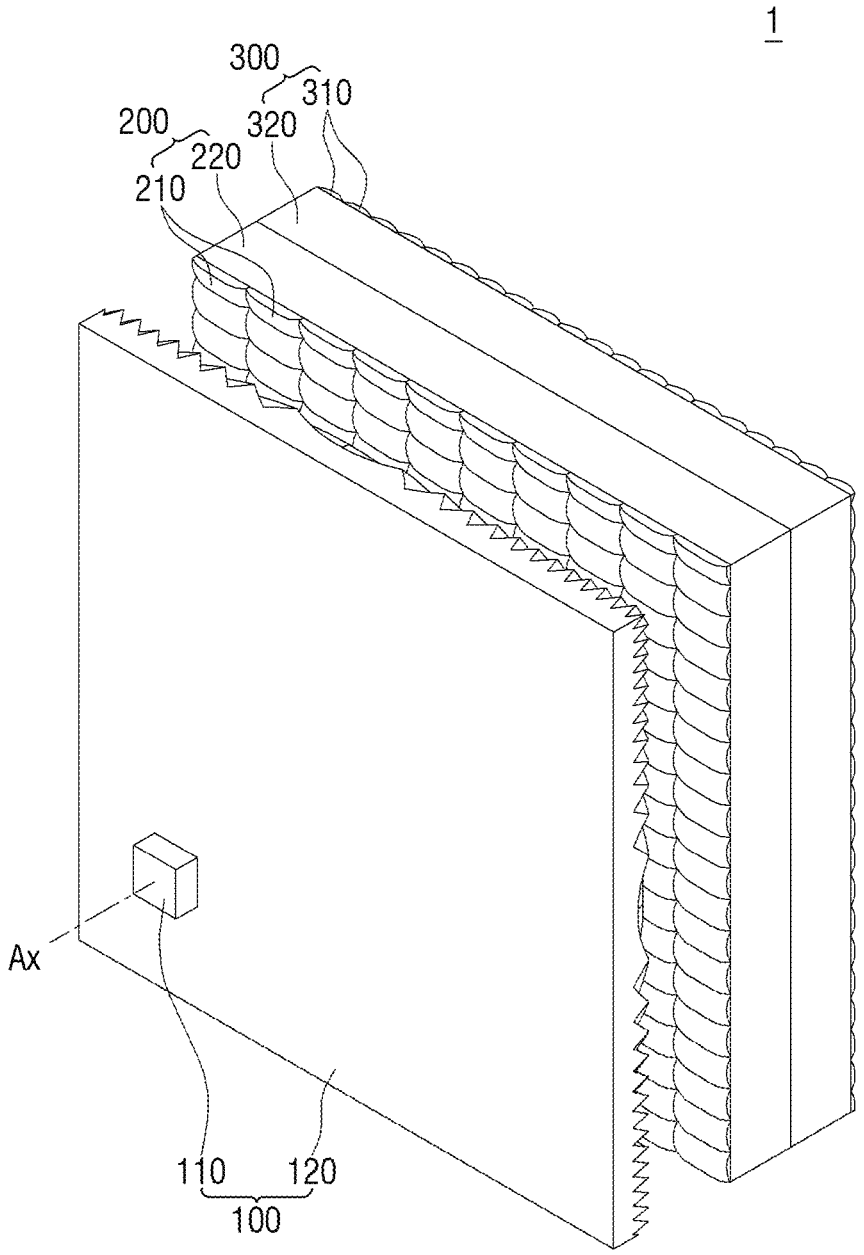
Figure 3:
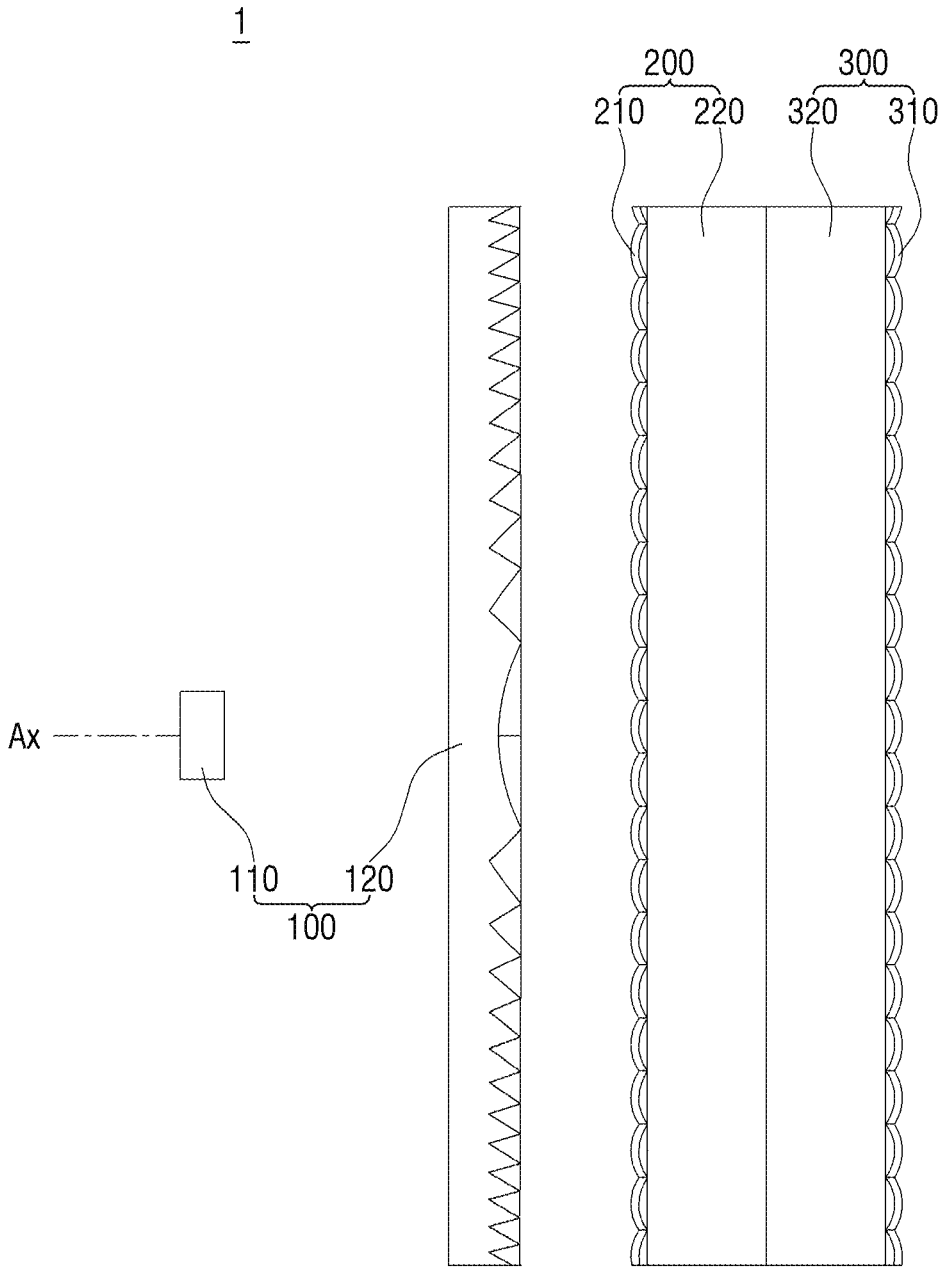
FIG. 3 is a side view of the vehicle lamp according to the embodiment of the present disclosure.
Figure 4:
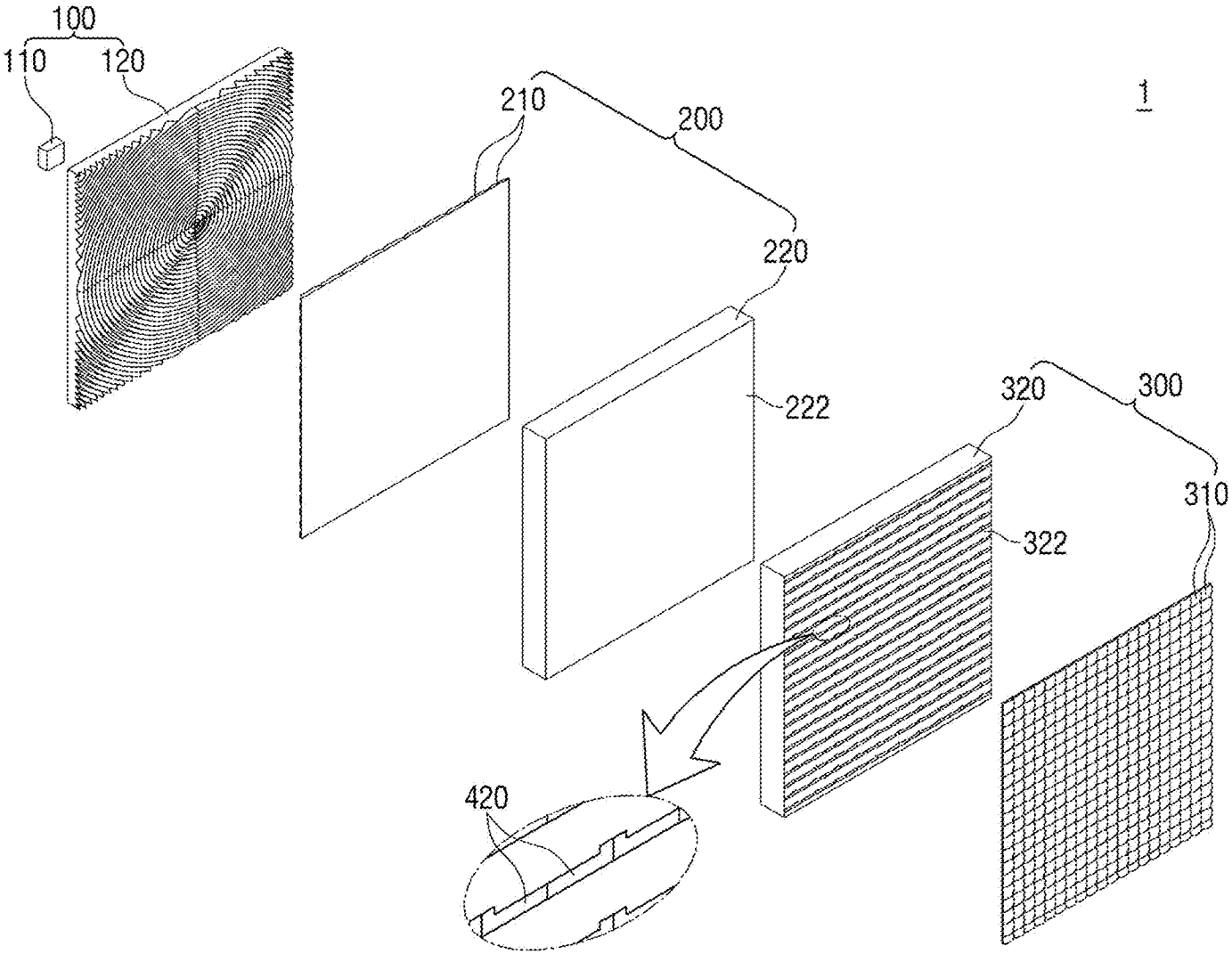
FIGS. 4 and 5 are exploded perspective views of the vehicle lamp according to the embodiment of the present disclosure.
Figure 5:
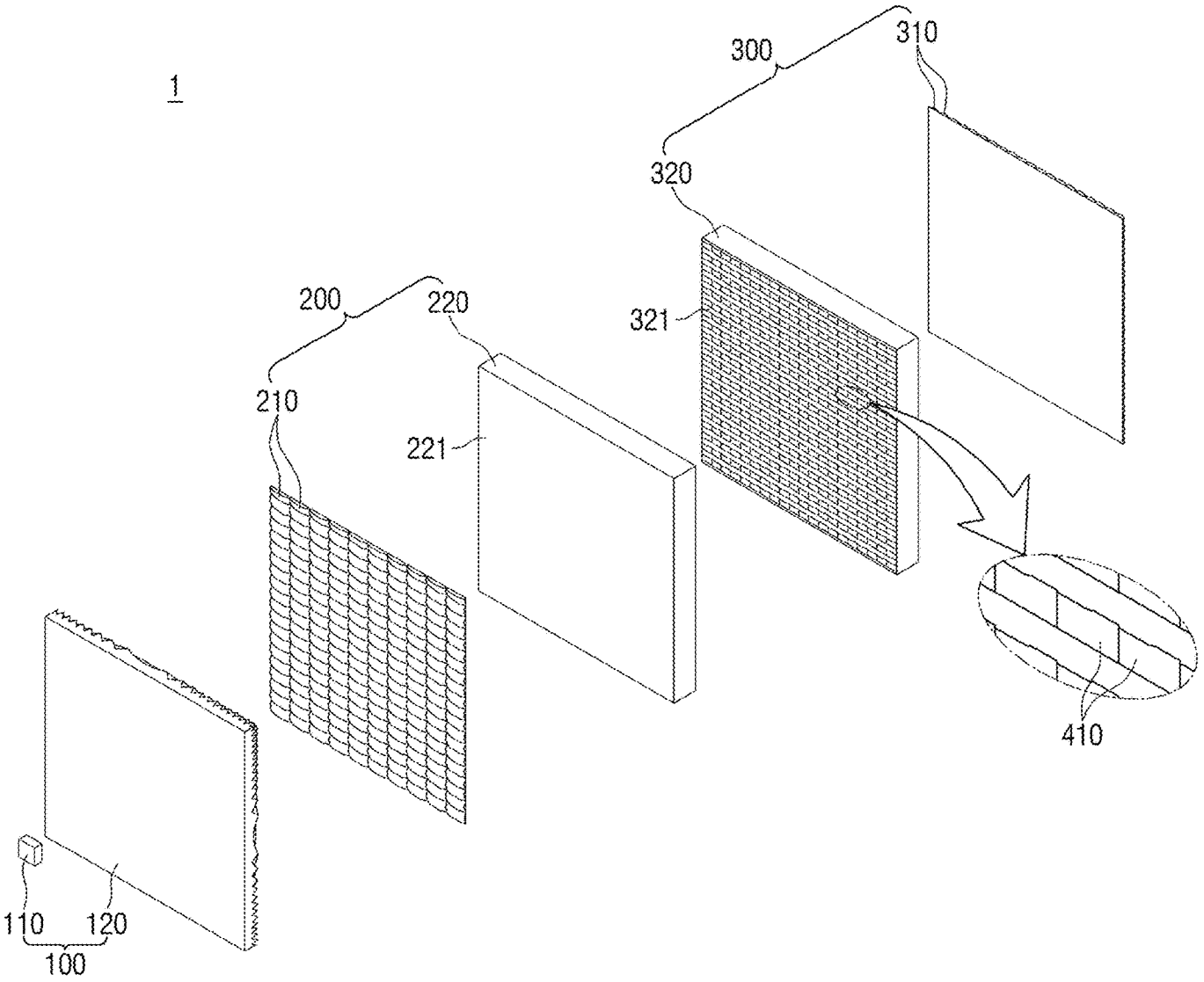

FIGS. 1 and 2 are perspective views of a vehicle lamp 1 according to an embodiment of the present disclosure. FIG. 3 is a side view of the vehicle lamp 1 according to the embodiment of the present disclosure. FIGS. 4 and 5 are exploded perspective views of the vehicle lamp 1 according to the embodiment of the present disclosure.

Referring to FIGS. 1 through 5, the vehicle lamp 1 according to the embodiment of the present disclosure may include a light source unit 100, an incident lens unit 200, an exit lens unit 300, and a shield unit 400. The light source unit 100, the incident lens unit 200, the exit lens unit 300, and the shield unit 400 may be accommodated in an internal space formed by a lamp housing (not illustrated) and a cover lens (not illustrated) coupled to the lamp housing to cause light to be irradiated to the outside of a vehicle.

In the embodiment of the present disclosure, a case where the vehicle lamp 1 is used as a headlamp, which irradiates light in a driving direction of a vehicle to secure a driver's forward view when the vehicle is operating at night or in a dark place such as a tunnel, will be described as an example. However, the present disclosure is not limited thereto, and the vehicle lamp 1 of the present disclosure may be used not only as a headlamp but also as various lamps installed in vehicles, such as a tail lamp, a brake lamp, a fog lamp, a position lamp, a turn signal lamp, a daytime running lamp (DRL), and a backup lamp.

In addition, in the embodiment of the present disclosure, a case where the vehicle lamp 1 forms a low beam pattern, in which light is irradiated below a predetermined cutoff line so as not to dazzle drivers of vehicles ahead such as preceding vehicles or oncoming vehicles, will be described as an example. However, the present disclosure is not limited thereto, and the vehicle lamp 1 of the present disclosure may also form a high beam pattern to secure a long-distance view ahead of the vehicle or may be provided in plurality, depending on light distribution characteristics such as the size or brightness of a beam pattern.

The light source unit 100 may include a light source 110 and a light path adjustment unit 120 and may generate light of an amount and/or color suitable for use in the vehicle lamp 1 of the present disclosure.

In the embodiment of the present disclosure, a case where the light source 110 is implemented as a semiconductor light emitting element such as a light emitting diode (LED) will be described as an example. However, the present disclosure is not limited thereto, and various types of light sources such as a bulb and a laser diode (LD) may also be used as the light source 110. In addition, an optical element such as a reflector, a mirror, a prism, or a lens may be additionally used depending on the type of the light source 110 to direct light generated from the light source 110 to the incident lens unit 200.

The light path adjustment unit 120 may adjust the path of light to allow the light generated with a predetermined light irradiation angle from the light source 110 to travel substantially parallel to an optical axis Ax of the light source 110 and to enter the incident lens unit 200. The optical axis Ax of the light source 110 may be understood as an imaginary line that passes perpendicularly through the center of an emission surface of the light source 110. The optical axis Ax of the light source 110 may be understood as an optical axis of the light source unit 100.

The light path adjustment unit 120 may reduce light loss by allowing the light generated from the light source 110 to enter the incident lens unit 200 at a maximum amount. In addition, the light path adjustment unit 120 may make the light that is incident on the incident lens unit 200 become parallel to the optical axis Ax of the light source 110 by adjusting the path of the light, which enables the light generated from the light source 110 to be uniformly incident on the incident lens unit 200 so that a beam pattern formed by the vehicle lamp 1 of the present disclosure may exhibit uniform brightness.

In the embodiment of the present disclosure, a Fresnel lens including several annular lenses may be used as the light path adjustment unit 120 to reduce thickness and adjust the path of light generated from the light source 110 to be parallel to the optical axis Ax of the light source 110. However, the present disclosure is not limited thereto, and various types of optical elements capable of adjusting the path of light generated from the light source 110, such as an aspheric lens, may also be used as the light path adjustment unit 120.

The incident lens unit 200 may include a plurality of incident lenses 210 and a first optical member 220. The incident lenses 210 may be disposed on an incident surface 221 of the first optical member 220, and light incident on the incident lenses 210 may exit through an exit surface 222 of the first optical member 220 to be transmitted to the exit lens unit 300 disposed in front of the incident lens unit 200 (with regards to the traveling direction of the light). The first optical member 220 may be made of a light transmitting material such as glass, to allow the light incident on the incident surface 221 from the light source unit 100 to exit through the exit surface 222.

In the embodiment of the present disclosure, a case where the incident lenses 210 are manufactured separately from the first optical member 220 and attached to the incident surface 221 of the first optical member 220 will be described as an example. However, the present disclosure is not limited thereto, and the incident lenses 210 may also be integrally manufactured with the first optical member 220 by surface processing or the like of the first optical member 220.

Herein, a case where the incident lenses 210 are implemented as micro lenses having a relatively short focal length to reduce the overall size of the vehicle lamp 1 of the present disclosure will be described as an example.

In the embodiment of the present disclosure, the incident lenses 210 may form a row that extends in the left and right directions (e.g., substantially horizontal), and one or more rows formed by the incident lenses 210 may be arranged in the up and down directions.

Figure 6:
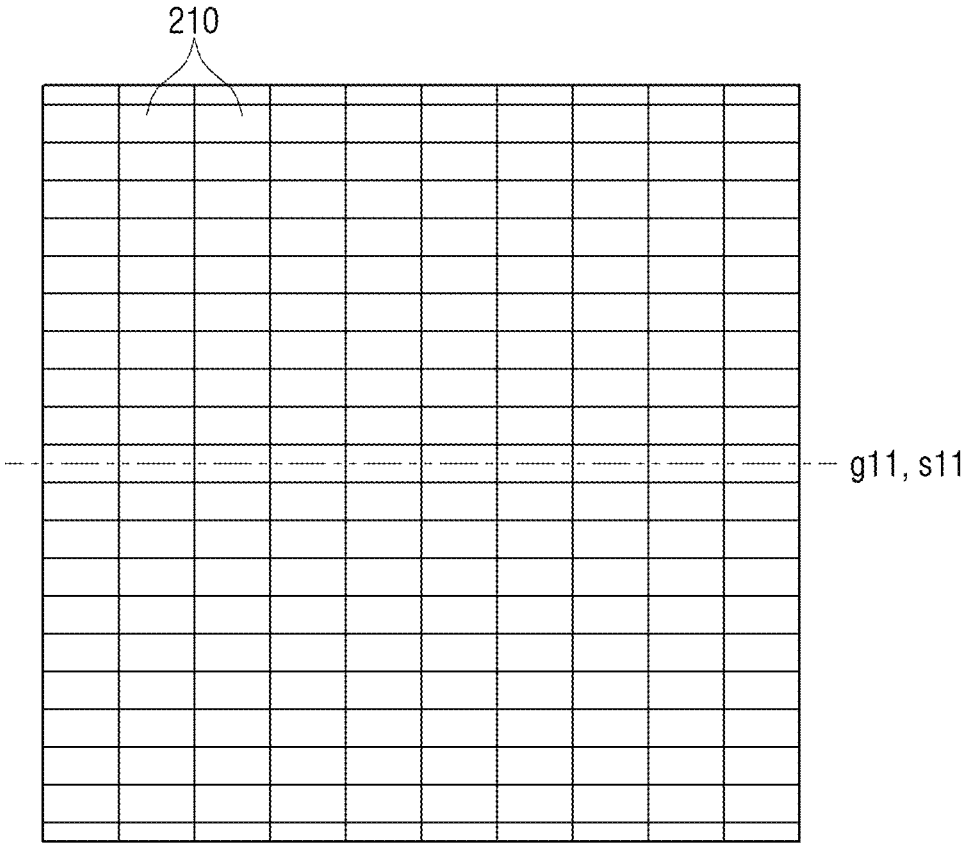
FIGS. 6 and 7 are schematic views of a plurality of incident lenses according to embodiments of the present disclosure.
Figure 7:
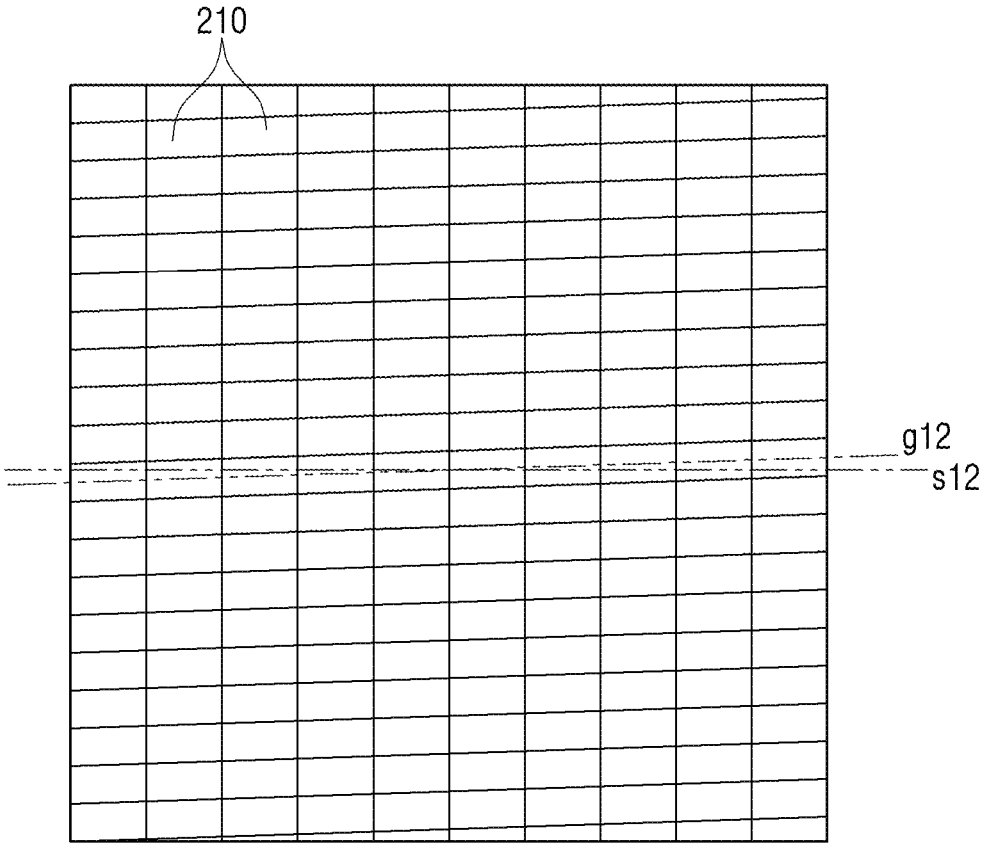

The rows formed by the incident lenses 210 may be parallel to a horizontal direction as illustrated in FIG. 6 or may be inclined at a predetermined angle with respect to the horizontal direction as illustrated in FIG. 7. The angle at which the rows are formed by the incident lenses 210 may determine the angle at which rows extending in the left and right directions are formed by a plurality of exit lenses 310 to be described later.

When the rows formed by the incident lenses 210 are parallel to the horizontal direction, it may be understood that a virtual line g11 connecting a specific point on each incident lens disposed in the left and right directions, for example, the center of each incident lens disposed in the left and right directions, is parallel to a horizontal line s11. When the rows formed by the incident lenses 210 are inclined at the predetermined angle with respect to the horizontal direction, it may be understood that a virtual line g12 connecting the center of each incident lens disposed in the left and right directions is inclined at the predetermined angle with respect to a horizontal line s12. Here, FIGS. 6 and 7 illustrate examples of the angle at which the rows are formed by the incident lenses 210 when the incident lens unit 200 is viewed from the light source unit 100.

The exit lens unit 300 may include a plurality of exit lenses 310 and a second optical member 320. The second optical member 320 may be made of a light transmitting material such as glass, to allow the light incident on an incident surface 321 from the incident lens unit 200 to exit through an exit surface 322. The exit lenses 310 may be disposed on the exit surface 322 of the second optical member 320.

The exit lenses 310 may be manufactured separately from the second optical member 320 and attached to the exit surface 322 of the second optical member 320 or may be integrally manufactured with the second optical member 320 by surface processing or the like of the second optical member 320.

Here, a case where the exit lenses 310, like the incident lenses 210 described above, are implemented as micro lenses having a relatively short focal length to reduce the overall size of the vehicle lamp 1 of the present disclosure will be described as an example.

Figure 8:
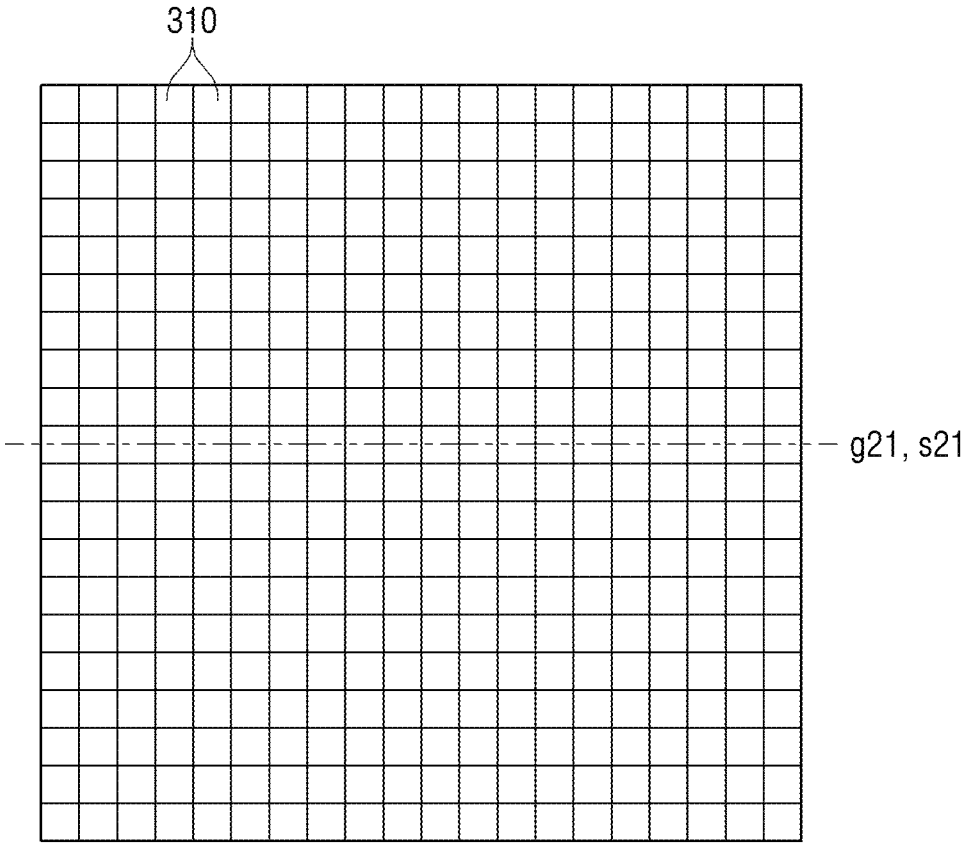
FIGS. 8 and 9 are schematic views of a plurality of exit lenses according to embodiments of the present disclosure.
Figure 9:
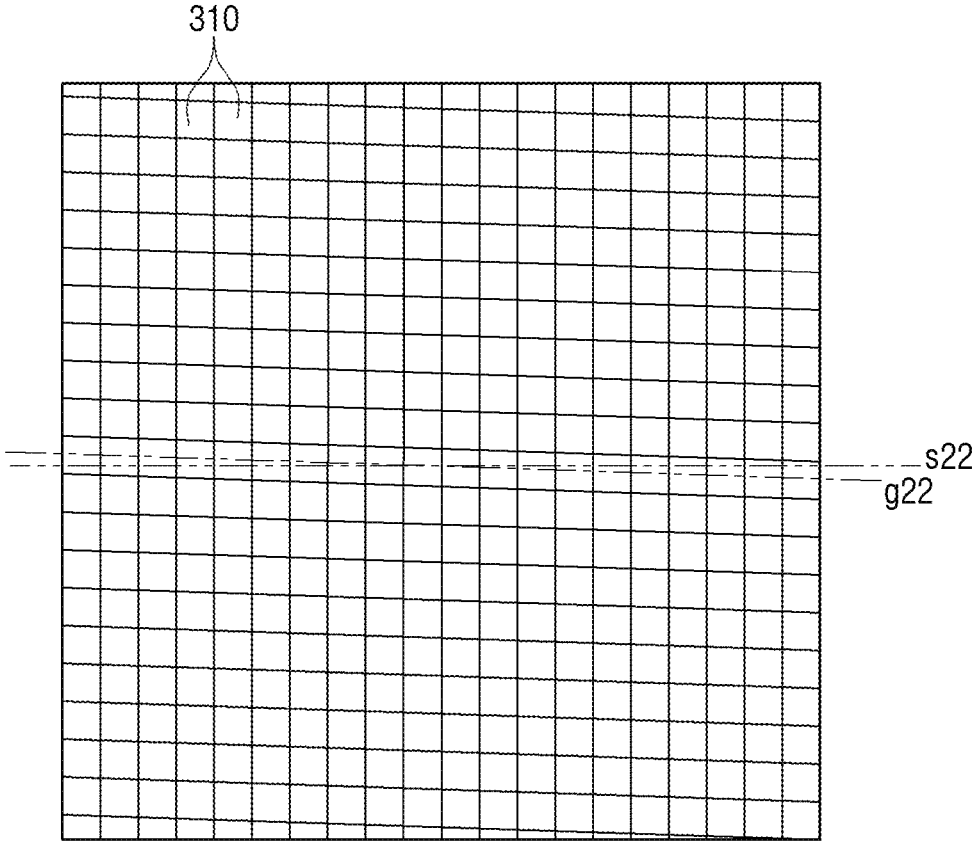

Like the incident lenses 210 described above, the exit lenses 310 may be disposed such that one or more rows that extend in the left and right directions are arranged in the up and down directions. The rows formed by the exit lenses 310 may be parallel to the horizontal direction as illustrated in FIG. 8 or may be inclined at a predetermined angle with respect to the horizontal direction as illustrated in FIG. 9 in accordance with the angle at which the rows are formed by the incident lenses 210.

Here, when the rows formed by the exit lenses 310 are parallel to the horizontal direction, it may be understood that a virtual line g21 connecting a specific point on each exit lens disposed in the left and right directions, for example, the center of each exit lens disposed in the left and right directions, is parallel to a horizontal line s21. When the rows formed by the exit lenses 310 are inclined at the predetermined angle with respect to the horizontal direction, it may be understood that a virtual line g22 connecting the center of each exit lens disposed in the left and right directions is inclined at the predetermined angle with respect to a horizontal line s22. Here, FIGS. 8 and 9 illustrate examples of the angle at which the rows are formed by the exit lenses 310 when the exit lens unit 300 is viewed from the front of the exit lens unit 300 (i.e., an opposite side from the light source unit 100).

In the embodiment of the present disclosure, a case where each of the incident lenses 210 includes a semi-cylindrical shape that extends in the left and right directions and where light incident on each of the incident lenses 210 is incident on a plurality of exit lenses disposed in the left and right directions among the exit lenses 310 will be described as an example. However, this is merely to ensure that a beam pattern formed by the vehicle lamp 1 of the present disclosure has appropriate light distribution characteristics, and the present disclosure is not limited to such a configuration. The incident lenses 210 and the exit lenses 310 may correspond to each other in a one-to-one, many-to-one, one-to-many, or many-to-many manner based on the light distribution characteristics of the beam pattern formed by the vehicle lamp 1 of the present disclosure.

The shield unit 400 may be disposed between the incident lenses 210 and the exit lenses 310 to obstruct (e.g., block) a part of light from being incident on each of the exit lenses 310 so that a beam pattern having a predetermined cutoff line may be formed by the vehicle lamp 1 of the present disclosure. For example, the shield unit 400 may cause a beam pattern by the vehicle lamp 1 of the present disclosure to be irradiated below a predetermined cutoff line, thereby forming a low beam pattern that does not dazzle drivers of vehicles ahead.

The shield unit 400 may be formed on any one of the first optical member 220 or the second optical member 320 by deposition or coating. In the embodiment of the present disclosure, a case where the shield unit 400 includes a plurality of shields 410 (e.g., primary shields) and a plurality of additional shields 420 (e.g., secondary or supplemental shields) disposed in front of the shields 410, respectively, will be described as an example. However, the present disclosure is not limited thereto, and the shield unit 400 may include the shields 410, or the additional shields 420, or both to form a cutoff line of a beam pattern.

In the embodiment of the present disclosure, the shields 410 and the additional shields 420 may be formed on the incident surface 321 and the exit surface 322 of the second optical member 320, respectively. However, the present disclosure is not limited thereto, and the shields 410 and the additional shields 420 may also be formed on the incident surface 221 and the exit surface 222 of the first optical member 220, respectively.

Figure 10:
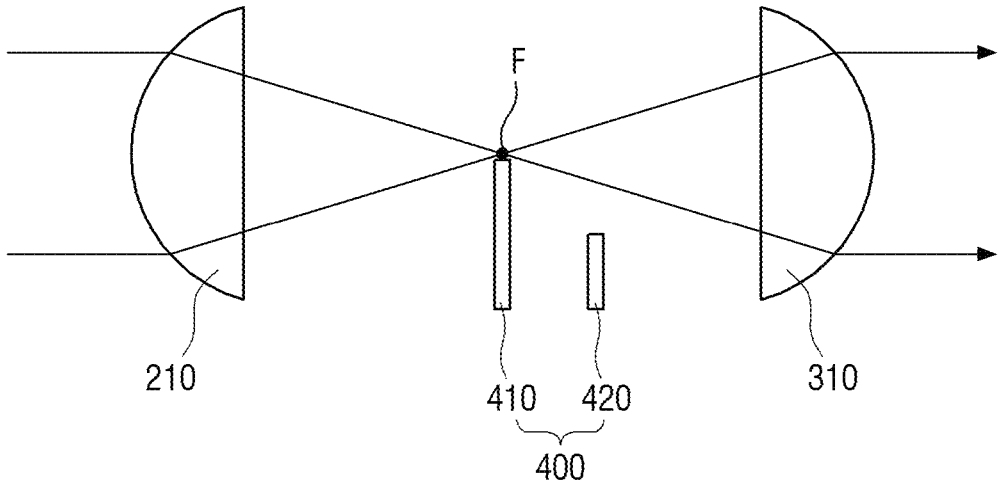
FIG. 10 is a schematic diagram illustrating the path of light between an incident lens and an exit lens according to an embodiment of the present disclosure.

In particular, as illustrated in FIG. 10, an upper end (e.g., a top line, a top edge) of each of the shields 410 may be disposed at or around a focal point F between an incident lens and an exit lens corresponding to each other among the incident lenses 210 and the exit lenses 310. In addition, when light incident parallel to the optical axis Ax of the light source unit 100 from the light source unit 100 passes through the focal point F between the incident lens and the exit lens corresponding to each other and exits parallel to the optical axis Ax of the light source unit 100 through the exit lens, each of the shields 410 may obstruct a part of the light travelling toward the exit lens.

Here, the position of the upper end of each of the shields 410 may vary according to the position of the focal point F between the incident lens and the exit lens corresponding to each other among the incident lenses 210 and the exit lenses 310. For example, when the rows formed by the incident lenses 210 and the rows formed by the exit lenses 310 are parallel to the horizontal direction, a line connecting specific points on the shields 410 may also be horizontal. On the other hand, when the rows formed by the incident lenses 210 and the rows formed by the exit lenses 310 are inclined at a predetermined angle with respect to the horizontal direction, the line connecting the specific points on the shields 410 may also be inclined at the predetermined angle with respect to the horizontal direction.

The shields 410 may obstruct a part of light travelling toward each of the exit lenses 310 to form a beam pattern having a predetermined cutoff line. Depending on the shape of the cutoff line, the upper end of each of the shields 410 may be formed to have different or varying heights on both sides of the center of the upper end as illustrated in FIGS. 11 and 12 or may be formed horizontally as illustrated in FIG. 13.

Figure 11:
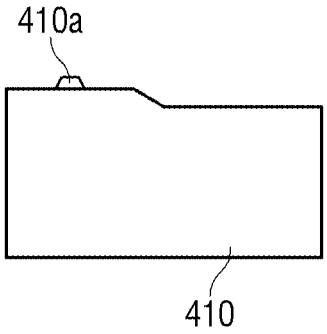
FIGS. 11 through 13 are schematic views of shields according to embodiments of the present disclosure.
Figure 12:
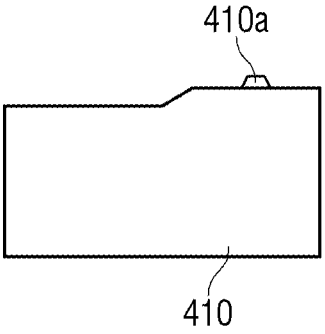
Figure 13:
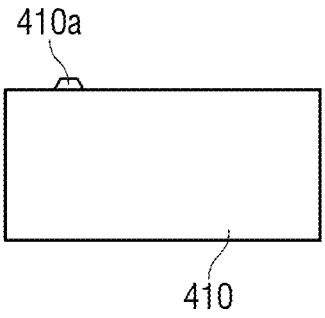

FIGS. 11 through 13 illustrate examples of the shape of each of the shields 410 when the exit lens unit 300 is viewed from the front of the exit lens unit 300. The shape of the upper end of each of the shields 410 is not limited the above examples and may be varied or flipped according to the local or regional standard. In addition, FIGS. 11 through 13 illustrate examples where a protrusion 410*a* that protrudes upward is formed on one side on the upper end of each of the shields 410. The protrusion 410*a* may prevent or reduce dazzle due to light reflected by the road surface at a short distance ahead of the vehicle. For example, the protrusion 410*a* may block light irradiated to a certain area at a short distance ahead of the vehicle so as to prevent or reduce dazzle due to the light reflected by, for example, the wet road surface when raining.

In addition, when the vehicle lamp 1 of the present disclosure is used as a headlamp, a lamp for a high illuminance area of a beam pattern and a lamp for a spread area may be used. The protrusion 410*a* may be formed on any one of a shield of the lamp for the high illuminance area or a shield of the lamp for the spread area according to local standards, or may be formed on both the shield of the lamp for the high illuminance area and the shield of the lamp for the spread area.

Hereinbelow, a case where no protrusion is formed on the upper end of the shields 410 will be described as an example. However, the same description may also be applied to a case where the protrusion 410*a* is formed.

When the upper end of each of the shields 410 is formed to have different heights on both sides of the center of the upper end as illustrated in FIGS. 11 and 12, a cutoff line CL of a beam pattern may include an inclined line CL1, an upper line CL2 that horizontally extends from an upper end of the inclined line CL1, and a lower line CL3 that horizontally extends from a lower end of the inclined line CL1. When the upper end of the shields 410 is formed horizontally, without an inclined line, as illustrated in FIG. 13, the cutoff line CL of the beam pattern may also be formed horizontally (e.g., as a straight line) as illustrated in FIG. 16.

Figure 14:
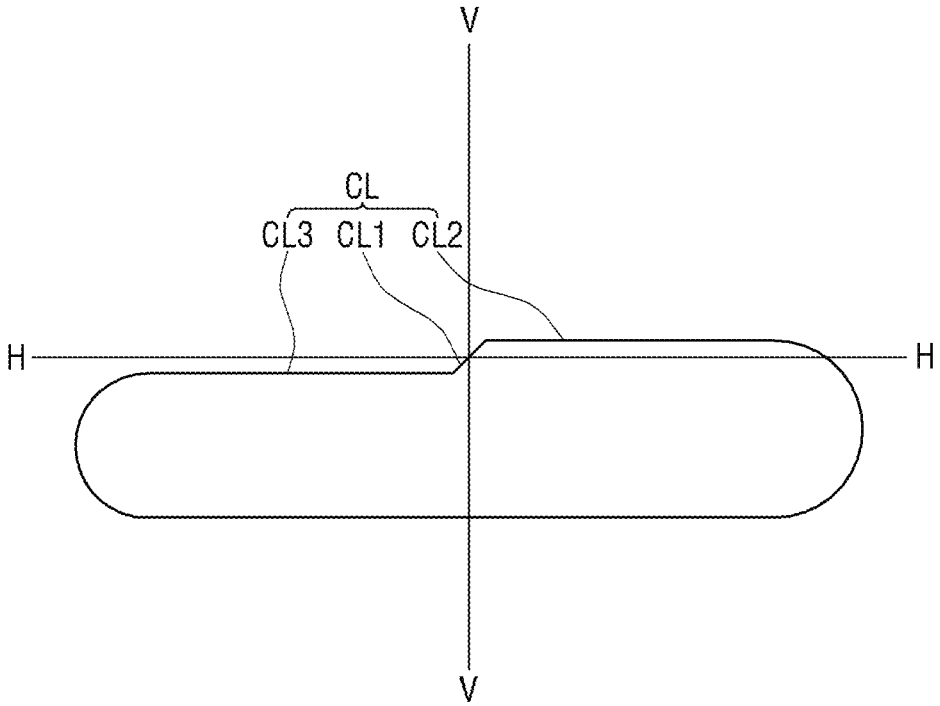
FIGS. 14 through 16 are schematic diagrams illustrating beam patterns formed by a vehicle lamp according to embodiments of the present disclosure.
Figure 15:
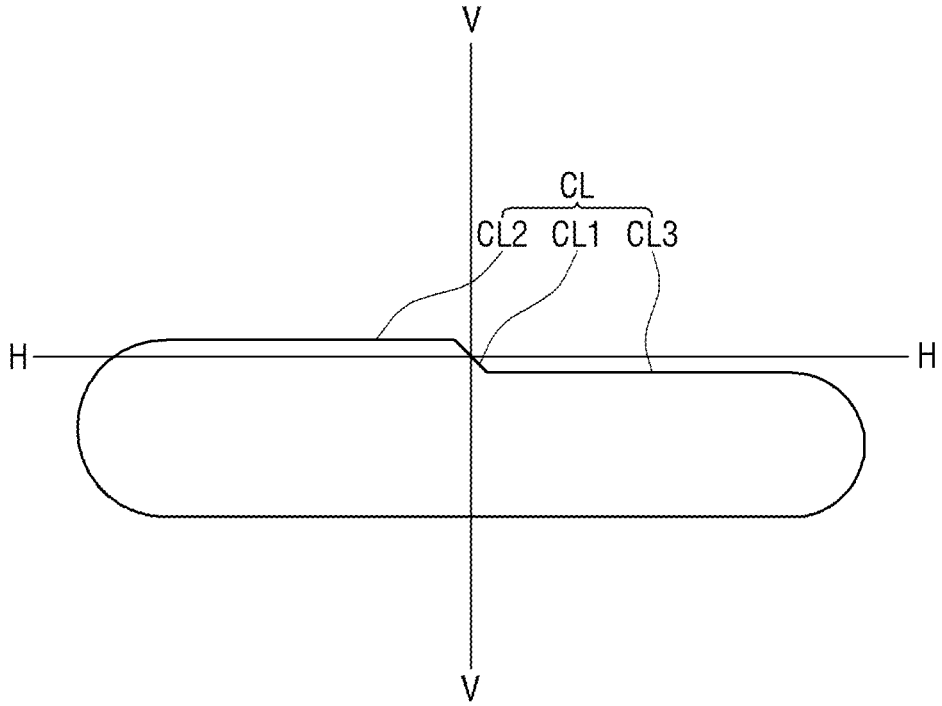
Figure 16:
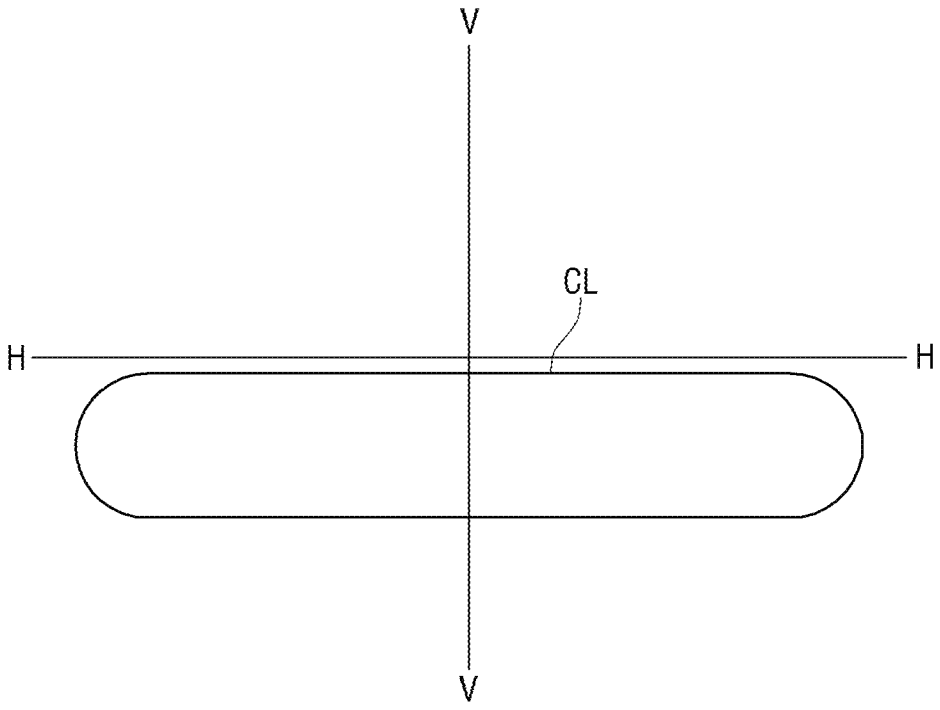

Here, FIGS. 14 through 16 illustrate examples of a beam pattern formed when light is irradiated from the vehicle lamp 1 of the present disclosure to a screen located at a predetermined distance ahead of the vehicle. FIGS. 11 and 14 are an example of the beam pattern suitable for left hand side driving (LHD), and FIGS. 12 and 15 are an example of the beam pattern suitable for right hand side drive (RHD).

The center of the upper end of each shield 410 may be disposed at or around a rear focal point of an exit lens 310, and a step (e.g., a height difference, an abrupt or discontinuous height change or level change) may or may not occur between adjacent shields depending on the angle at which the rows are formed by the exit lenses 310.

Hereinbelow, a description will be given for a case where a step does or does not occur between adjacent shields depending on the angle of the rows in the exit lenses 310. However, a similar description may be given for a case where a step does or does not occur between adjacent shields depending on the angle of the rows in the incident lenses 210.

Figure 17:
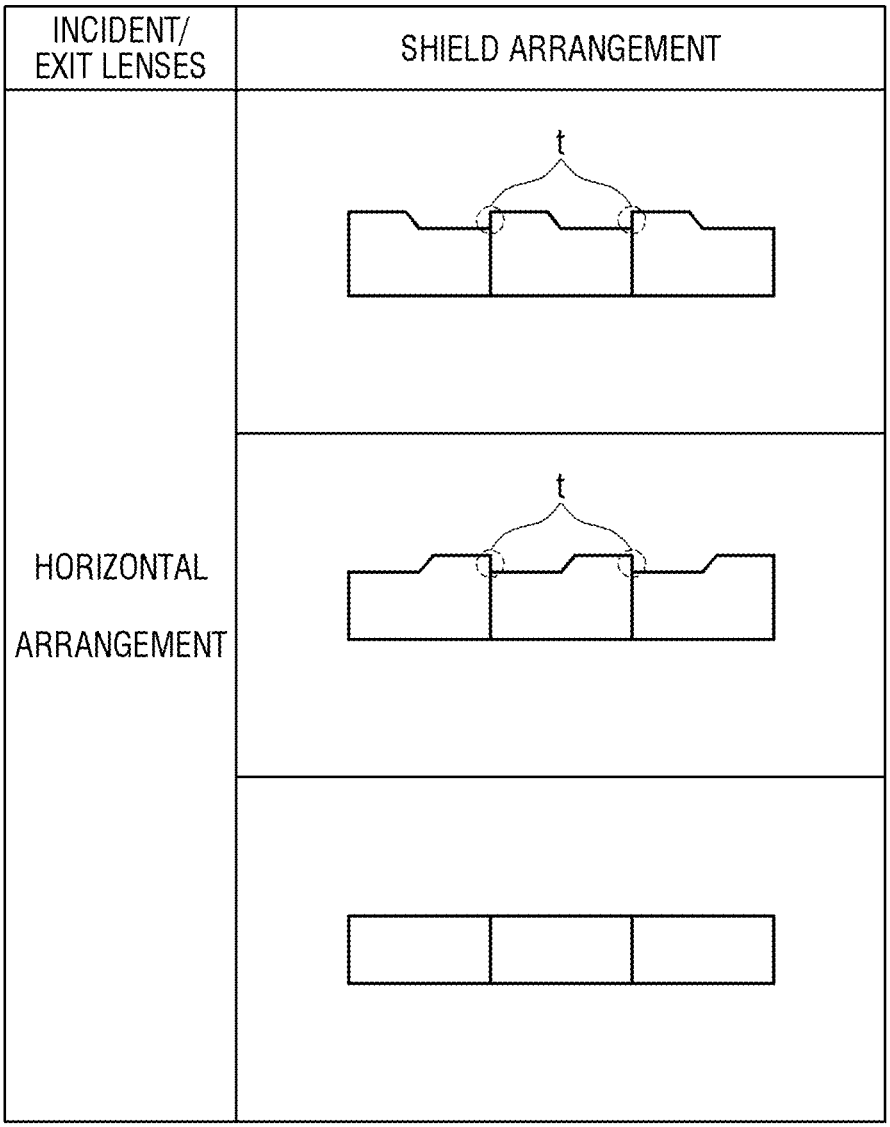
FIGS. 17 and 18 are schematic diagrams illustrating the arrangement of shields according to the arrangement of incident/exit lenses according to embodiments of the present disclosure.

For example, when the rows formed by the exit lenses 310 are parallel to the horizontal direction, if the upper ends of the shields 410 are shaped as illustrated in FIGS. 11 and 12, a height difference t may occur in the up and down directions between adjacent shields as illustrated in the first and the second rows of the table shown in FIG. 17. On the other hand, if the upper ends of the shields 410 are shaped as illustrated in FIG. 13, no height difference may occur between adjacent shields as illustrated in the third row of the table shown in FIG. 17.

Figure 18:
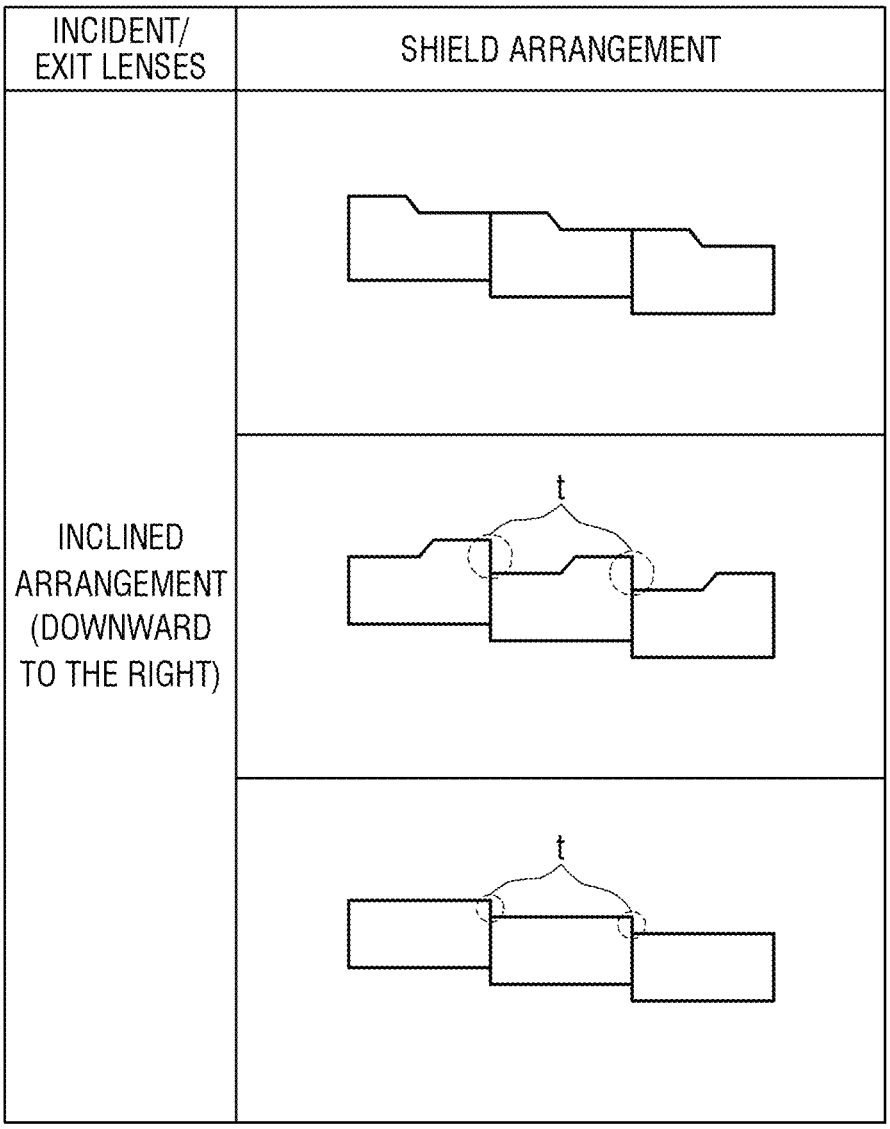

On the other hand, when the rows formed by the exit lenses 310 slope downward to the right, if the upper ends of the shields 410 are shaped as illustrated in FIG. 11, no height difference may occur as illustrated in the first row of the table shown in FIG. 18. On the other hand, if the upper ends of the shields 410 are shaped as illustrated in FIGS. 12 and 13, a height difference t may occur between adjacent shields as illustrated in the second and the third rows of the table shown in FIG. 18.

Here, in FIG. 18, a case where the rows formed by the exit lenses 310 slope downward to the right is described as an example. However, the present disclosure is not limited thereto. When the rows formed by the exit lenses 310 slope upward to the right, a height difference may occur if the upper ends of the shields 410 are shaped as illustrated in FIGS. 11 and 13, and no height difference may occur if the upper ends of the shields 410 are shaped as illustrated in FIG. 12.

When a step occurs between adjacent shields among the shields 410 as described above, an area A1 that protrudes above the cutoff line or an area A2 depressed or recessed below the cutoff line may be generated. Accordingly, a driver's view may not be sufficiently secured, or drivers of vehicles ahead may be dazzled. Therefore, a different incident lens unit 200 and exit lens unit 300 are required for each different shape of the upper end of each of the shields 410, where the rows of the incident lenses 210 and the rows of the exit lenses 310 are formed at different angles. However, this may increase the overall cost or process, thereby reducing productivity.

Figure 19:
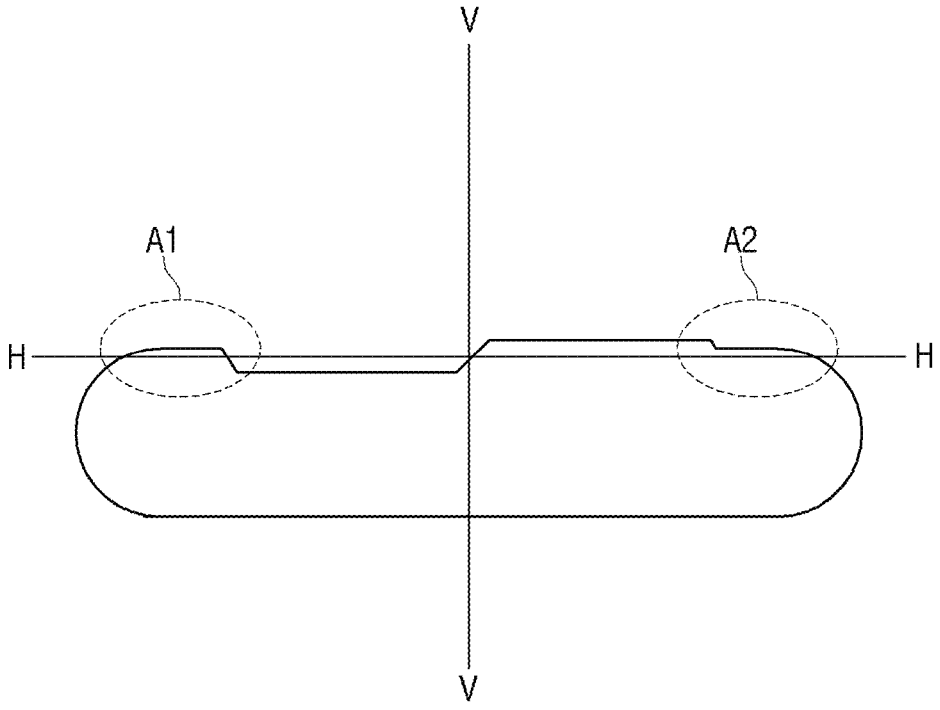
FIGS. 19 through 21 are schematic diagrams illustrating beam patterns formed when a height difference occurs between shields according to embodiments of the present disclosure.
Figure 20:
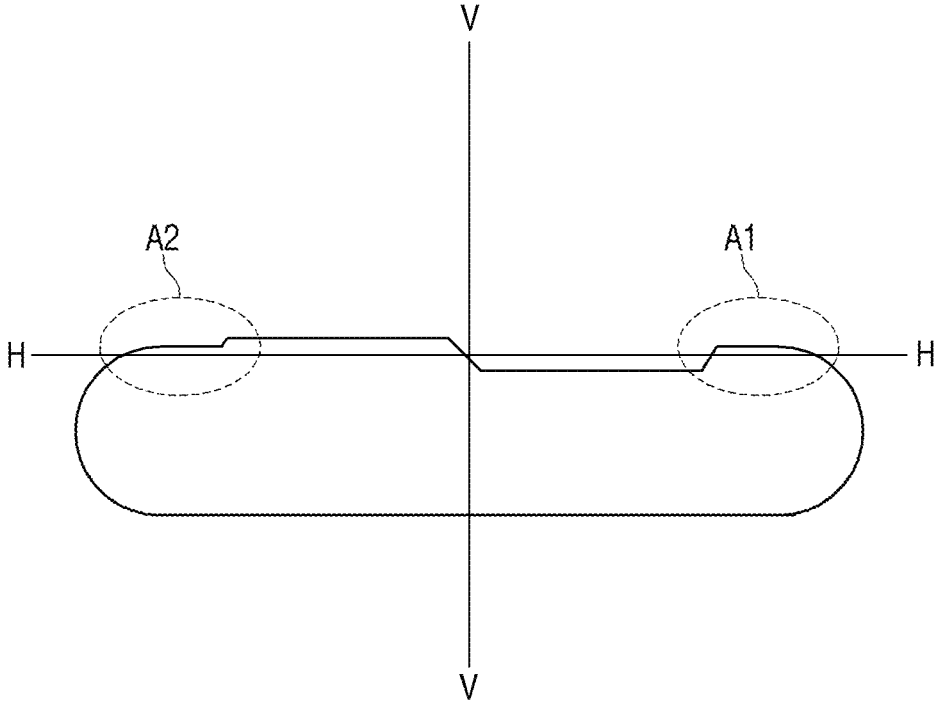
Figure 21:
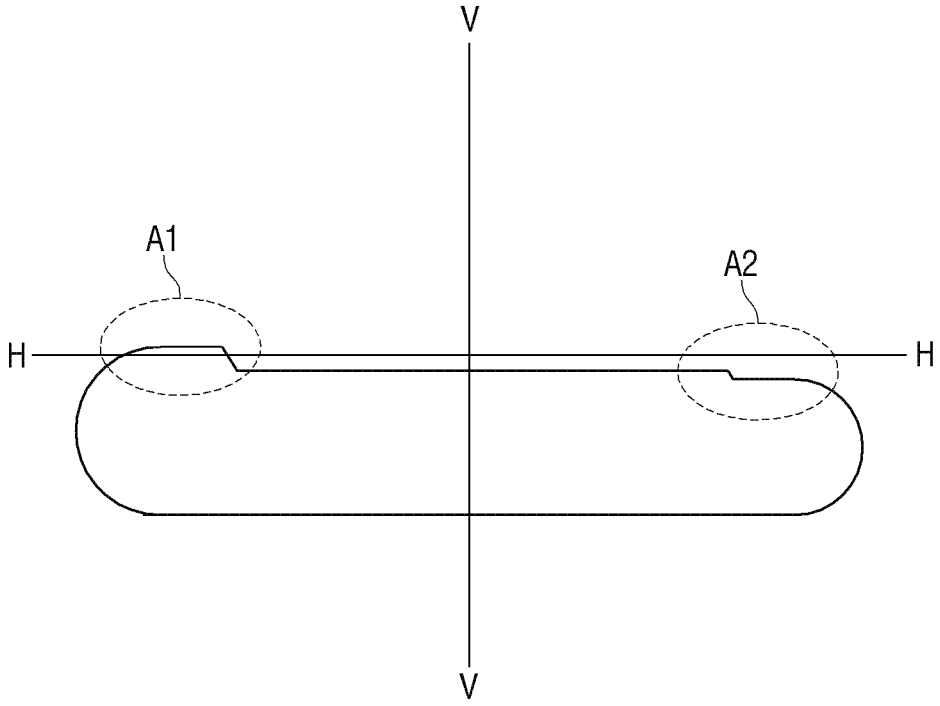

Therefore, in the embodiment of the present disclosure, the incident lens unit 200 and the exit lens unit 300 may be made to be still usable even if the shape of the upper end of each of the shields 410 is changed. This improves productivity by reducing cost or process while preventing the formation of an abnormal beam pattern such as those illustrated in FIGS. 19 through 21.

Figure 22:
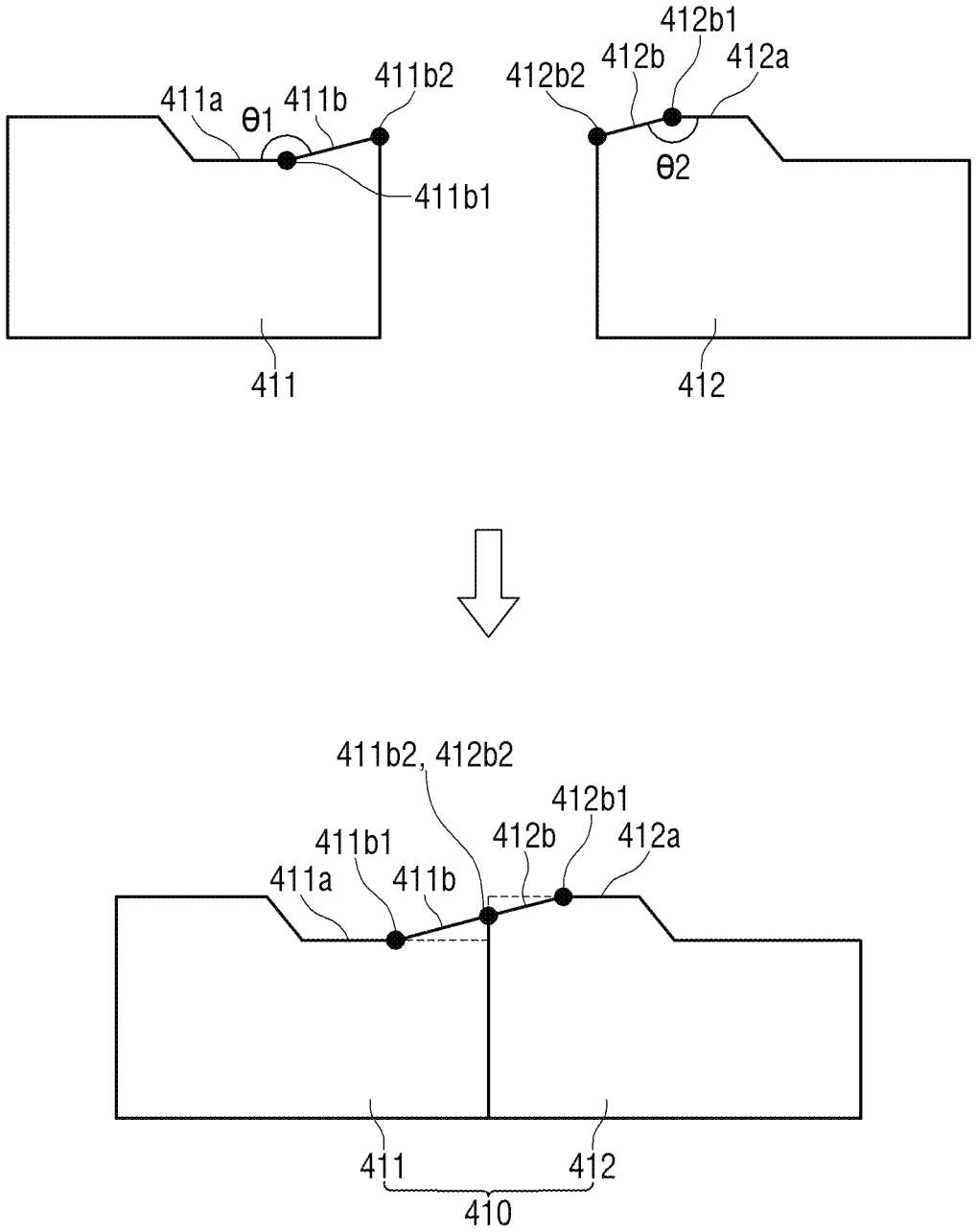
FIGS. 22 through 24 are schematic views of shields, each including a horizontal part and a connection part, according to embodiments of the present disclosure.
Figure 23:
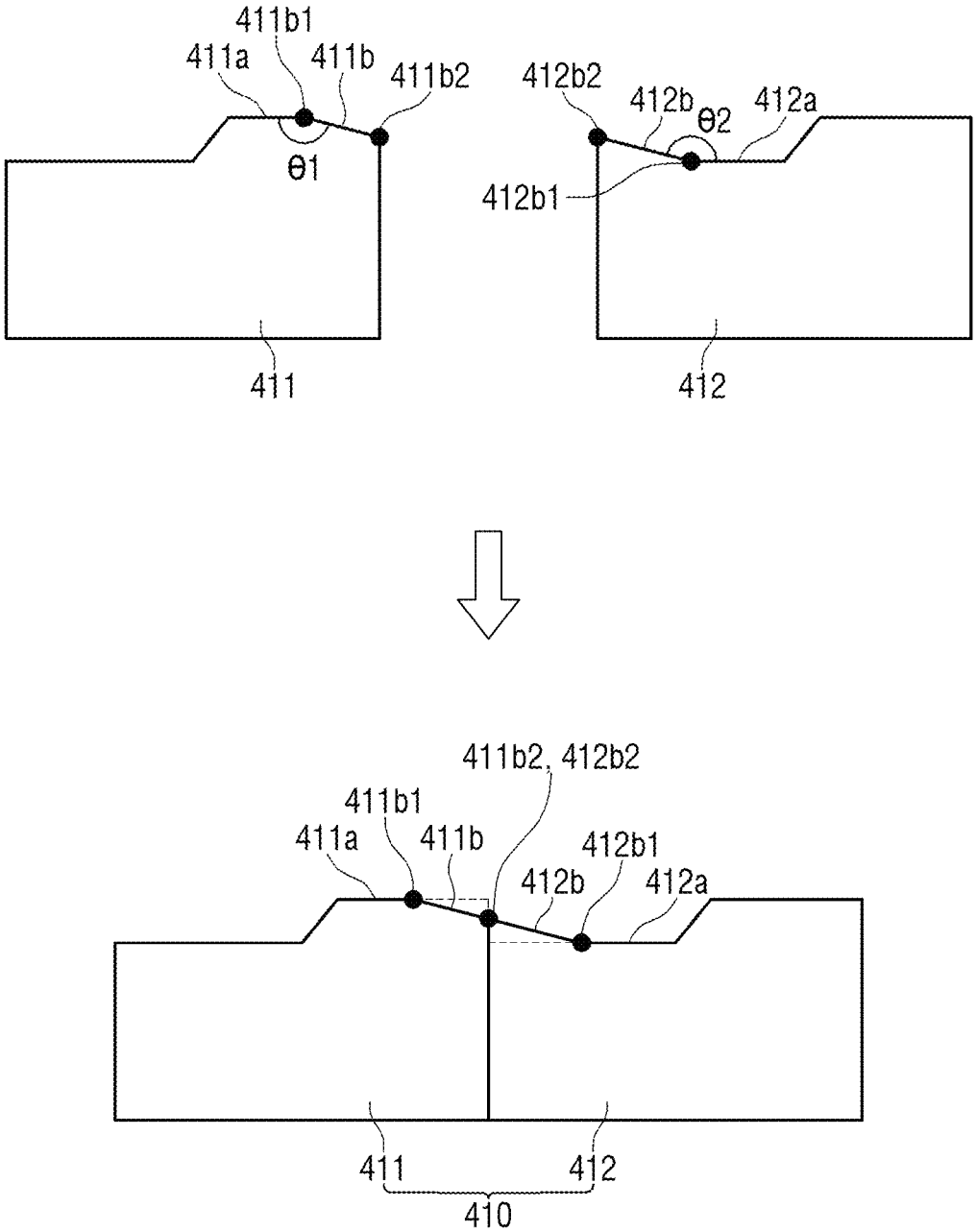
Figure 24:
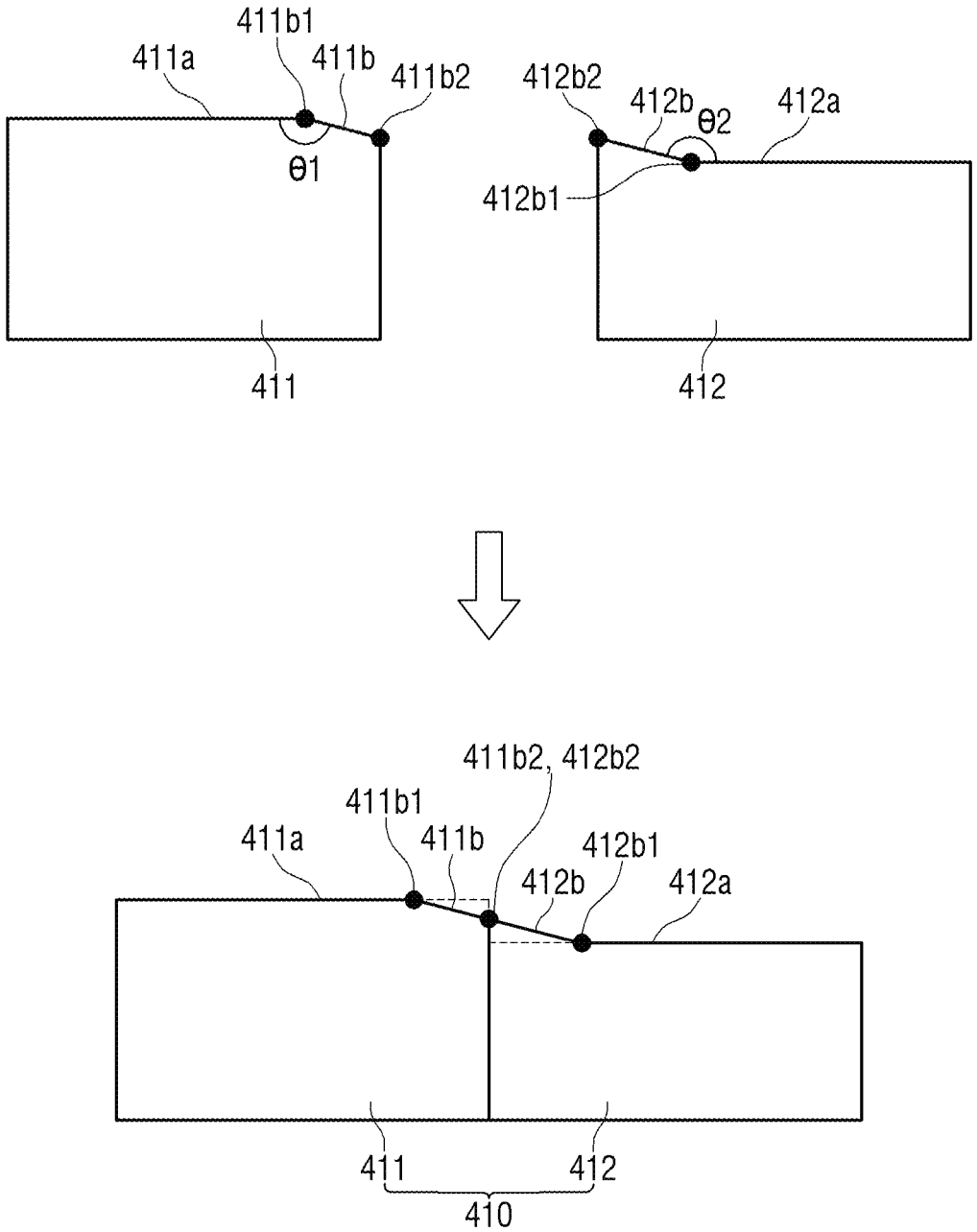

In the embodiment of the present disclosure, as illustrated in FIGS. 22 through 24, the upper end of each of the shields 410 may include a horizontal part 411*a* or 412*a* that extend horizontally from the center of the upper end toward an adjacent shield, and a connection part 411*b* or 412*b* that extends from the horizontal part 411*a* or 412*a* toward the adjacent shield in a different direction from the horizontal part 411*a* or 412*a*.

FIGS. 22 through 24 illustrate examples of a first shield 411 and a second shield 412 disposed adjacent to each other in the left and right directions among the shields 410. It may be understood that the second shield 412 is disposed on a right side of the first shield 411 when the exit lens unit 300 is viewed from the front of the exit lens unit 300.

The first shield 411 may include the horizontal part 411*a* and the connection part 411*b* that extend from the center of the upper end toward the second shield 412. Similarly, the second shield 412 may include the horizontal part 412*a* and the connection part 412*b* that extend from the center of the upper end toward the first shield 411. The connection part 411*b* of the first shield 411 and the connection part 412*b* of the second shield 412 may enable the horizontal part 411*a* of the first shield 411 and the horizontal part 412*a* of the second shield 412 to be smoothly connected without a step, thereby preventing a cutoff line of a beam pattern from being formed abnormally due to the step between the adjacent shields.

In other words, when the upper ends of the first shield 411 and the second shield 412 include only the horizontal parts 411*a* and 412*a* that extend from the centers of the upper ends toward each other, a step may occur between the first shield 411 and the second shield 412 as indicated by the dotted lines in FIGS. 22 through 24. Therefore, as illustrated in FIGS. 17 and 18, a step may occur between adjacent shields depending on the angle at which the rows are formed by the exit lenses 310. However, in the embodiment of the present disclosure, the horizontal part 411*a* of the first shield 411 and the horizontal part 412*a* of the second shield 412 may be connected to each other without a step via the connection part 411*b* of the first shield 411 and the connection part 412*b* of the second shield 412. Therefore, the formation of an abnormal beam pattern due to the step can be prevented or reduced.

The first shield 411 may be formed such that a line connecting both ends of the horizontal part 411*a* in the left and right directions and a line connecting both ends 411*b*1 and 411*b*2 of the connection part 411*b* in the left and right directions form an obtuse angle θ1. Similarly, the second shield 412 may also be formed such that a line connecting both ends of the horizontal part 412*a* in the left and right directions and a line connecting both ends 412*b*1 and 412*b*2 of the connection part 412*b* form an obtuse angle θ2. Therefore, the height (e.g., the top line or top edge) of the adjacent shields may change smoothly.

For example, when the horizontal part 411*a* of the first shield 411 is disposed lower than the horizontal part 412*a* of the second shield 412 as illustrated in FIG. 22, the connection part 411*b* of the first shield 411 may be formed such that an end 411*b*2 close to the second shield 412 is disposed higher than the other end 411*b*1 connected to the horizontal part 411*a* of the first shield 411. Similarly, the connection part 412*b* of the second shield 412 may be formed such that an end 412*b*2 close to the first shield 411 is disposed lower than the other end 412*b*1 connected to the horizontal part 412*a* of the second shield 412. In addition, the connection part 411*b* of the first shield 411 and the connection part 412*b* of the second shield 412 may be formed to meet each other without an abrupt or discontinuous height change. Therefore, an area extending from the horizontal part 411*a* of the first shield 411 to the horizontal part 412*a* of the second shield 412 may gradually slope upward or downward from one side to the other side.

In the above-described embodiment, a case where the horizontal part 411*a* of the first shield 411 is disposed lower than the horizontal part 412*a* of the second shield 412 is described as an example. However, the above description may also be similarly applied to the case where the configuration is an mirror image.

In addition, in FIGS. 22 through 24, a case where the connection part 411*b* of the first shield 411 and the connection part 412*b* of the second shield 412 are formed in a linear shape that is inclined at a predetermined angle with respect to the horizontal direction is described as an example. However, this is merely an example to help understand the present disclosure, and the present disclosure is not limited thereto. An area between both ends 411*b*1 and 411*b*2 of the connection part 411*b* of the first shield 411 and an area between both ends 412*b*1 and 412*b*2 of the connection part 412*b* of the second shield 412 may be shaped as a straight line, a curve, or any combination thereof.

Figure 25:
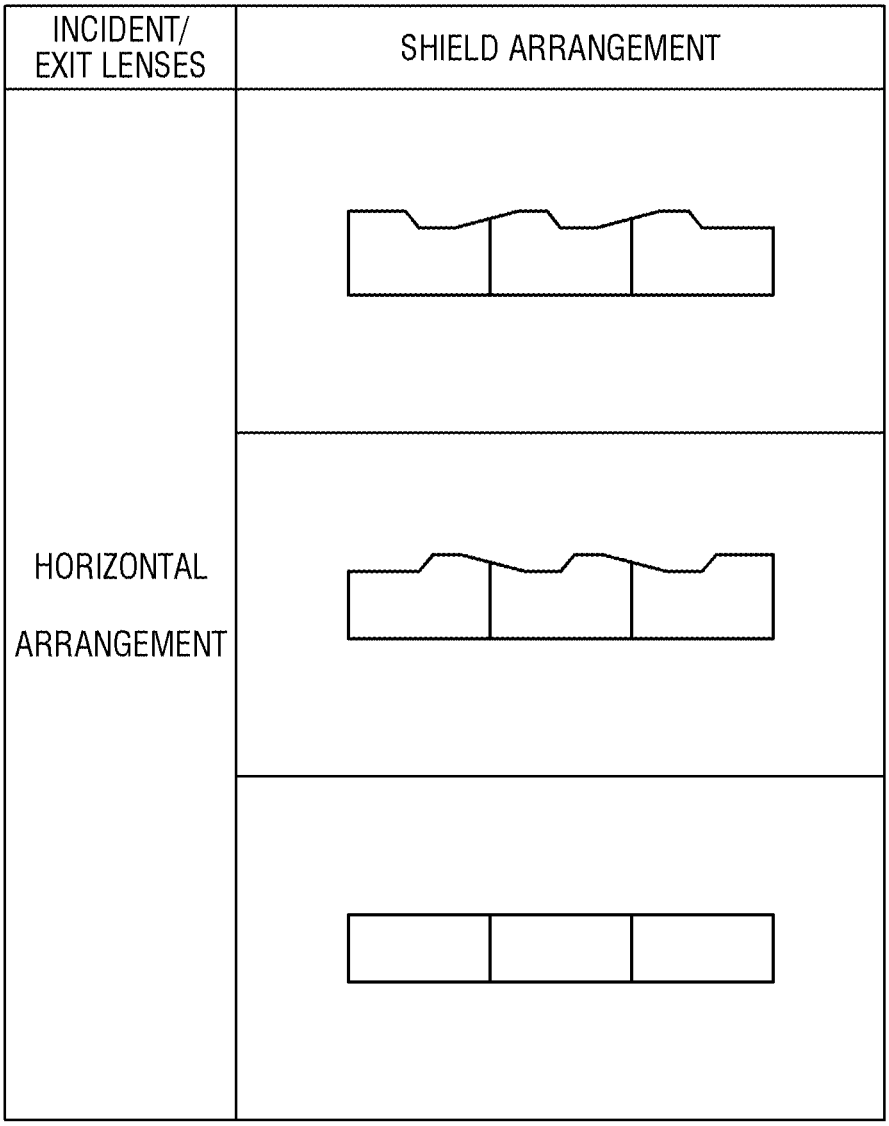
FIGS. 25 and 26 are schematic diagrams illustrating the arrangement of shields, each including a horizontal part and a connection part, according to embodiments of the present disclosure.
Figure 26:
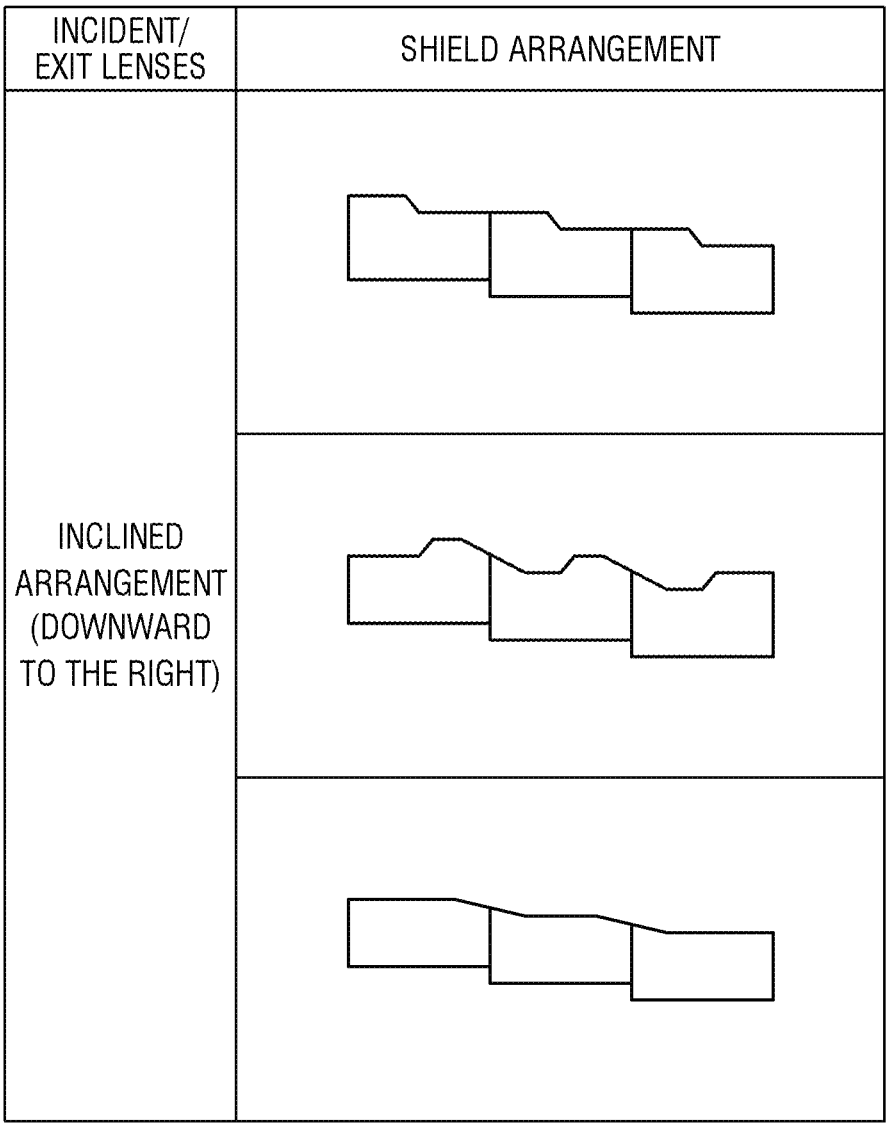

If the height of the horizontal parts 411*a* and 412*a* of shields adjacent to each other is smoothly changed due to the connection parts 411*b* and 412*b* as described above, when the rows formed by the incident lenses 210 and the rows formed by the exit lenses 310 are parallel to the horizontal direction or inclined at a predetermined angle with respect to the horizontal direction, the height of the adjacent shields adjacent to each other in the left and right directions may change smoothly as illustrated in FIGS. 25 and 26 regardless of which shape the upper ends of the shields 410 have as illustrated in FIGS. 11 through 13. Therefore, an area protruding above or depressed below the cutoff line as illustrated in FIGS. 14 through 16 may be prevented from being formed, and the formation of an abnormal beam pattern may be prevented.

In the embodiment of the present disclosure, a case where the upper end of each of the shields 410 has a horizontal part and a connection part that extend from the center of the upper end toward an adjacent shield so that the upper ends of the shields adjacent to each other may be smoothly changed without a step is described as an example. However, the present disclosure is not limited thereto, and a lower end of each of the shields 410, like the upper ends, may also have a horizontal part and a connection part so that the lower ends of the shields may smoothly change without a step.

In addition, the additional shields 420 may prevent glare by causing a cutoff line of a beam pattern formed by the vehicle lamp 1 of the present disclosure to be formed horizontally. Like the shields 410, upper and/or lower sides of additional shields adjacent to each other in the left and right directions may have different positions in the up and down directions in accordance with the angle of the rows of the incident lenses 210 and the rows of the exit lenses 310 with respect to the horizontal direction. In addition, like the shields 410 described above, the additional shields 420 may be formed such that the height of adjacent additional shields changes smoothly.

A vehicle lamp of the present disclosure described above provides at least one of the following advantages.

An upper end of each of a plurality of shields may include a horizontal part extending horizontally from the center of the upper end toward an adjacent shield and a connection part extending in a different direction from the horizontal part toward the adjacent shield. Since the height of shields adjacent to each other in left and right directions may be made to change smoothly by changing the direction in which the connection part extends in accordance with the height difference between the adjacent shields, the formation of an abnormal beam pattern due to the step between the adjacent shields may be prevented.

In addition, even when a height difference occurs between shields adjacent to each other in the left and right directions due to an angle at which rows of a plurality of incident lenses and rows of a plurality of exit lenses are formed, the height of the adjacent shields may be made to change smoothly by changing the direction in which the connection part extends. Therefore, the incident lenses and the exit lenses may be universally used. This may prevent an increase in cost or process and improves productivity.

However, the effects of the present disclosure are not restricted to the ones set forth herein. The above and other effects of the present disclosure will become more apparent to one of daily skill in the art to which the present disclosure pertains by referencing the claims.

While the present disclosure has been particularly shown and described with reference to exemplary embodiments thereof, it will be understood by those of ordinary skill in the art that various changes in form and detail may be made therein without departing from the spirit and scope of the present disclosure as defined by the following claims. The exemplary embodiments should be considered in a descriptive sense only and not for purposes of limitation. The scope of the present disclosure is defined by the following claims, rather than by the above-described detailed description. The meanings and scope of the claims, and all modifications or modified shapes, which are derived from equivalent concepts thereof, should be understood as being included in the scope of the present disclosure.

In concluding the detailed description, those skilled in the art will appreciate that many variations and modifications can be made to the preferred embodiments without substantially departing from the principles of the present invention. Therefore, the disclosed preferred embodiments of the invention are used in a generic and descriptive sense only and not for purposes of limitation.

What is claimed is:

1. A vehicle lamp comprising:

a light source unit;

an incident lens unit that comprises a plurality of incident lenses on which light is incident from the light source unit;

an exit lens unit that comprises a plurality of exit lenses outputting light incident from the incident lens unit; and a shield unit that obstructs a part of the light incident from the incident lens unit from travelling toward each of the plurality of exit lenses, wherein the shield unit comprises a plurality of shields, each of the plurality of shields corresponding to an incident lens among the plurality of incident lenses or an exit lens among the plurality of exit lenses, wherein an upper end of each of the plurality of shields comprises:

a horizontal part that extends horizontally from a center of the upper end toward an adjacent shield in a left or right direction; and a connection part that extends from the horizontal part toward the adjacent shield at an angle different from the horizontal part, and wherein connection parts of adjacent shields are connected to each other without a height difference.

2. The vehicle lamp of claim 1, wherein the light source unit comprises:

a light source; and a light path adjustment unit that adjusts a path of the light to cause the light generated from the light source unit to travel substantially parallel to an optical axis of the light source.

3. The vehicle lamp of claim 2, wherein the light path adjustment unit comprises at least one of an aspheric lens or a Fresnel lens.

4. The vehicle lamp of claim 1, wherein each of the plurality of shields is formed such that a line connecting both ends of the horizontal part in a left-right direction and a line connecting both ends of the connection part form an obtuse angle.

5. The vehicle lamp of claim 1, wherein the plurality of shields are disposed in a row that extends in a left-right direction, and one or more rows of the plurality of shields are arranged in an up-down direction, and wherein the connection parts of all shields that form the row are connected to each other without forming a step.

6. The vehicle lamp of claim 5, wherein in each of the plurality of shields, a first end of the connection part that is closer to the adjacent shield is disposed higher or lower than a second end of the connection part that is connected to the horizontal part.

7. The vehicle lamp of claim 6, wherein the connection part is shaped as a straight line, a curve, or a combination thereof.

8. The vehicle lamp of claim 1, wherein the plurality of incident lenses and the plurality of exit lenses are disposed such that one or more rows extending in a left-right direction are arranged in an up-down direction, and wherein a direction in which the connection part extends is determined in accordance with an angle of the rows extending in the left-right direction to a horizontal direction.

9. The vehicle lamp of claim 1, wherein at least some of the plurality of shields include a protrusion that protrudes upward on the upper end thereof.

10. The vehicle lamp of claim 1, wherein the shield unit further comprises a plurality of additional shields respectively disposed in front of the plurality of shields along a traveling direction of the light.

11. The vehicle lamp of claim 10, wherein the plurality of incident lenses and the plurality of exit lenses are disposed such that one or more rows extending in a left-right direction are arranged in an up-down direction, and wherein when the rows extending in the left-right direction are inclined at a predetermined angle with respect to a horizontal direction, upper and/or lower sides of additional shields adjacent to each other in the left-right direction have different positions in up-down direction.

* * * * *